US008225733B2

(12) United States Patent
Batard et al.

(10) Patent No.: US 8,225,733 B2
(45) Date of Patent: Jul. 24, 2012

(54) FLOATING CRAFT SUCH AS A SHIP PROVIDED WITH MEANS FOR COLLECTING A POLLUTING FLUID IN CASE OF DISASTER, AND METHOD FOR COLLECTING SAID FLUID

(75) Inventors: Guillaume Batard, Paris (FR); Gilles Longueve, Boissy-sans-Avoir (FR)

(73) Assignee: JLMD Ecologic Group (FR)

( * ) Notice: Subject to any disclaimer, the term of this patent is extended or adjusted under 35 U.S.C. 154(b) by 83 days.

(21) Appl. No.: 12/598,701

(22) PCT Filed: Apr. 14, 2008

(86) PCT No.: PCT/FR2008/000515

§ 371 (c)(1),
(2), (4) Date: Nov. 17, 2009

(87) PCT Pub. No.: WO2008/142288

PCT Pub. Date: Nov. 27, 2008

(65) Prior Publication Data

US 2010/0089457 A1 Apr. 15, 2010

(30) Foreign Application Priority Data

May 4, 2007 (FR) ..... 07 03211

(51) Int. Cl.
*B63B 25/08* (2006.01)

(52) U.S. Cl. ..... 114/74 R

(58) Field of Classification Search ..... 114/74 R, 114/74 A

See application file for complete search history.

(56) References Cited

U.S. PATENT DOCUMENTS

| | | | | |
|---|---|---|---|---|
| 4,014,358 | A * | 3/1977 | Andersson | 137/1 |
| 4,064,756 | A * | 12/1977 | MacLean et al. | 374/138 |
| 4,408,943 | A * | 10/1983 | McTamaney et al. | 137/899.2 |
| 4,923,219 | A * | 5/1990 | Bormioli | 285/18 |
| 5,052,319 | A * | 10/1991 | Beyrouty | 114/74 T |
| 5,795,103 | A | 8/1998 | Gaerlan | |
| 6,076,480 | A * | 6/2000 | Chang et al. | 114/125 |
| 7,004,095 | B2 * | 2/2006 | Bronneberg et al. | 114/74 R |
| 2003/0167992 | A1 * | 9/2003 | Robinson | 114/74 R |

FOREIGN PATENT DOCUMENTS

| | | | |
|---|---|---|---|
| DE | 9490174.0 | U1 | 6/1995 |
| FR | 2849640 | A1 | 7/2004 |
| FR | 2869012 | A1 | 10/2005 |
| FR | 2878225 | A1 | 5/2006 |
| GB | 2281060 | A | 2/1995 |

OTHER PUBLICATIONS

International Search Report PCT/FR2008/000515; Dated Feb. 2, 2009.

* cited by examiner

*Primary Examiner* — Stephen Avila
(74) *Attorney, Agent, or Firm* — Cantor Colburn LLP

(57) ABSTRACT

The invention relates to a floating craft such as a ship that includes at least one tank of a polluting fluid and at least one rescue connector communicating with the tank. The floating craft such as a ship is characterized in that the connector is connected to the tank by a linking mechanism, at least a portion of which is dedicated to at least one function that is operational outside rescue situations.

13 Claims, 13 Drawing Sheets

FLOATING CRAFT SUCH AS A SHIP PROVIDED WITH MEANS FOR COLLECTING A POLLUTING FLUID IN CASE OF DISASTER, AND METHOD FOR COLLECTING SAID FLUID

TECHNICAL FIELD OF THE INVENTION

The present invention relates to a floating craft such as a ship fitted with means for recovering polluting fluid in the event of an emergency, and to a method for recovering this fluid.

BRIEF DESCRIPTION OF RELATED ART

Patents FR2849640, FR2869012 and FR2878225 belonging to the applicant describe various systems for recovering a polluting fluid from inside the tanks of a ship in distress, that is to say a ship that has run aground or sunk.

These systems use the principle of expelling the polluting fluid from the tank under the effect of injecting seawater into the tank.

In these systems of the prior art, the ship must be fitted with specific means dedicated to the operations for recovering the polluting fluid: the installation of these specific means requires additional deck piercings, and generates increased complexity and increased costs relative to a standard ship not provided with such recovery means.

BRIEF SUMMARY OF THE RELATED ART

The invention provides a ship fitted with means for recovering polluting fluid requiring fewer additional deck piercings or even none at all.

This invention provides a floating craft such as a ship comprising at least one tank of polluting fluid and at least one salvage connector communicating with said tank, notable in that this connector is connected to said tank by connecting means whereof at least a portion is assigned to at least one function which is operational outside salvage situations.

By virtue of these features, the connector is connected to a member which, in normal times, is used for other functions on the floating craft.

In other words, this means that it is not necessary to provide ducts specifically reserved for the operations of recovering polluting fluid in the event of an emergency: in this way, it is possible to dispense with piercing the deck of the floating craft with additional ducts, and to limit the increased complexity and costs related thereto.

According to other optional features of the floating craft according to the invention:

said floating craft comprises at least a first salvage connector and a second salvage connector communicating with said tank, at least one of these connectors being connected to said tank by connecting means whereof at least a portion is assigned to at least one function that is operational outside salvage situations;

said function is chosen from a group comprising the ventilation of said tank, the decompression of said tank, the dipping of said tank, the filling of said tank, the draining of the overflow of said tank, the inspection of said tank, the cleaning of said tank: these functions are those that are routinely fulfilled outside salvage situations by ducts communicating with the tanks of the ships;

said tank is a bunker for fuel necessary for the propulsion of said floating craft: this, in this instance, is the particular case in which the tank is actually a fuel tank for the floating craft, the polluting fluid then being this fuel;

said connecting means comprise two independent ducts for ventilating said bunker, surmounted by said connectors and vents;

said connecting means comprise a first duct for ventilating said bunker surmounted by one of said connectors and a vent, a second ventilation duct connected to said first ventilation duct and a specific salvage duct connected to said second ventilation duct and surmounted by the other connector;

said connecting means comprise a duct for ventilating said bunker surmounted by one of said connectors and a vent, and a specific salvage duct connected to said bunker and surmounted by the other connector;

said connecting means comprise a duct for dipping said bunker surmounted by one of said connectors, an overflow duct connected to said tank, and a special salvage duct connected to said overflow duct and surmounted by the other connector: the various variants indicated in the above four paragraphs correspond to the various bunker configurations that may be encountered on the ships;

said tank is a tank for transporting said polluting fluid: it involves in this instance the situation in which the tank (s) form(s) the majority of the volume of the ship, which is dedicated to the transport of fluid; it is particularly the case with tankers;

said connecting means comprise a ventilation duct surmounted by one of said connectors and a ventilator;

said connecting means comprise a decompression duct surmounted by one of said connectors and a decompression valve;

said connecting means comprise a duct for filling said tank surmounted by one of said connectors;

said connecting means comprise a manhole plate mounted removably on said tank and surmounted by one of said connectors;

said connecting means comprise a cleaning plug mounted removably on said tank and surmounted by one of said connectors: the various variants indicated in the above four paragraphs correspond to the various communication means that may be encountered on the tanks of tankers;

at least one of said connectors is connected in a T-connection to its associated duct: such a T-connector is simple to produce and makes it possible to maintain the normal use of the duct outside salvage situations;

said connectors are of the bolted blind flange type: these connectors, of very simple design, are easy and cheap to use;

said connectors are placed above the deck of said floating craft: this arrangement allows particularly easy access to these connectors when the ship is in an emergency situation, and particularly when it rests on the sea bottom.

The present invention also relates to a method for extracting a polluting fluid situated in at least one tank of a floating craft such as a ship in distress, notable in that the user pumps said fluid through at least one duct which is assigned at least partly to at least one function which is operational outside salvage situations.

The present invention also relates to a method for extracting a polluting fluid situated in at least one tank of a floating craft such as a ship in distress, notable in that the user injects an expulsion fluid such as seawater into said tank through at least a first duct and in that the user recovers said polluting fluid through at least a second duct, at least one of these two ducts being assigned at least partly to at least one function that is operational outside salvage situations.

BRIEF DESCRIPTION OF THE DRAWINGS

Other features and advantages of the present invention will appear in the light of the following description and on examination of the appended figures in which.

DETAILED DESCRIPTION OF THE INVENTION

Figure 1:
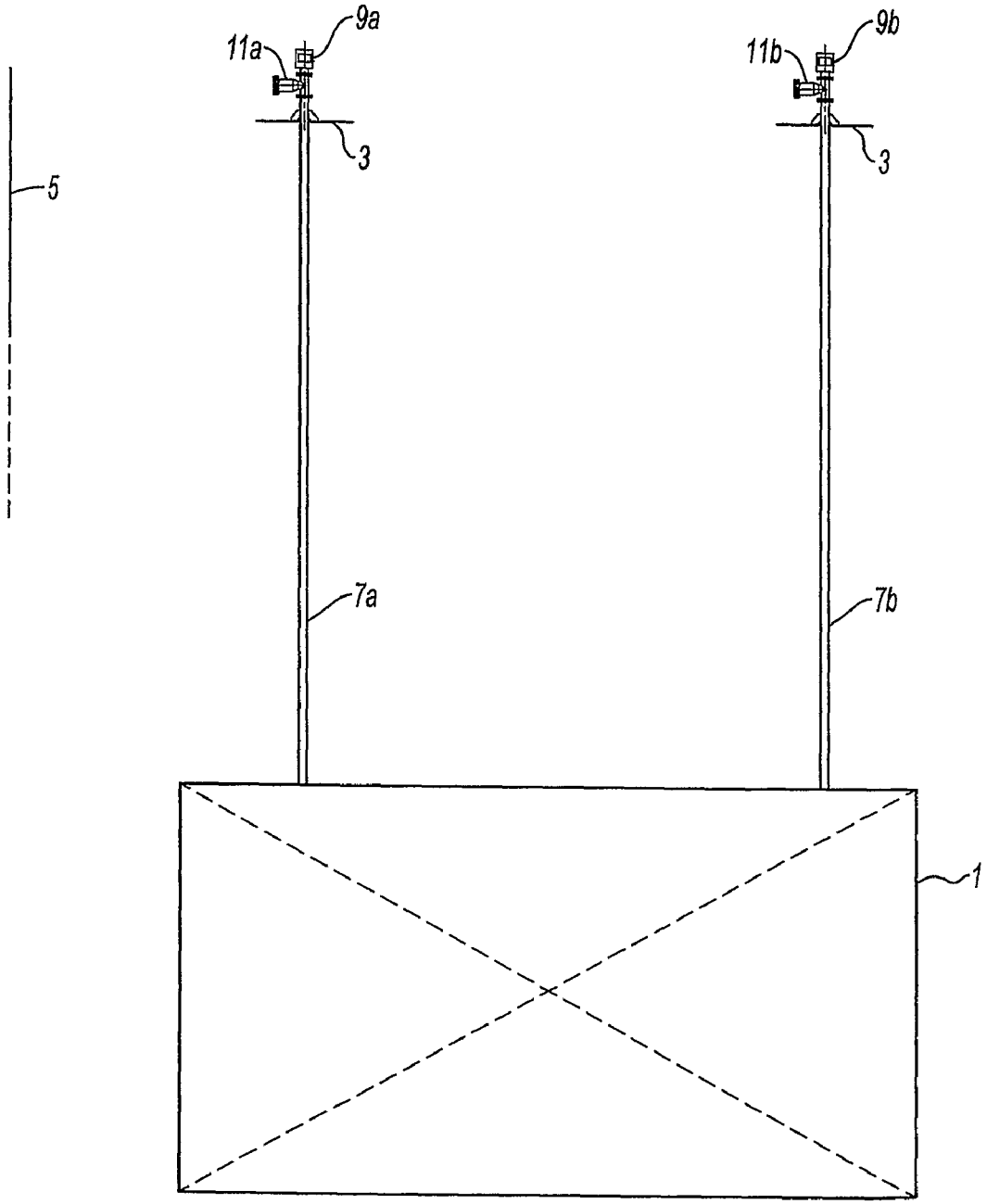
FIGS. 1, 4, 6 and 7 represent schematically four configurations of ships comprising bunkers fitted with means for recovering fluid according to the invention.

Reference is now made to FIG. 1, in which a bunker 1 is represented, placed beneath the deck 3 of a ship 5, this bunker being designed to receive, for example, fuel necessary for the propulsion of the ship 5.

This bunker comprises two ventilation ducts 7*a* and 7*b* piercing the deck 3 and each surmounted on the one hand by a vent 9*a*, 9*b* and on the other hand by a connector 11*a*, 11*b* fitted in a T-connection to these ducts.

Figure 2:
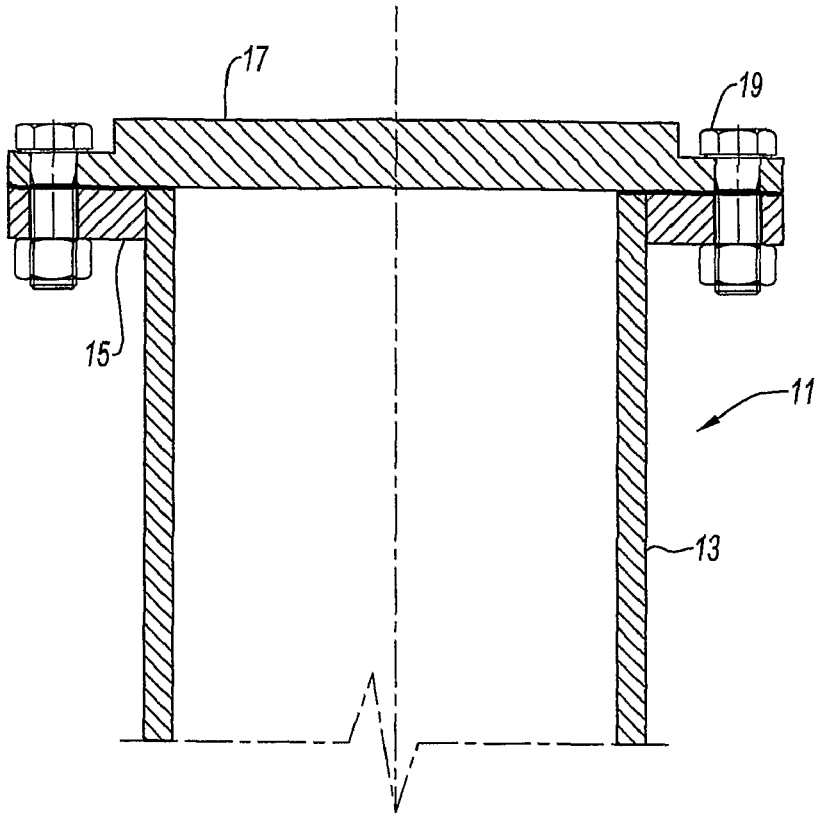
FIGS. 2 and 3 represent, in axial section and in top view respectively, a connector forming part of these fluid-recovery means.
Figure 3:
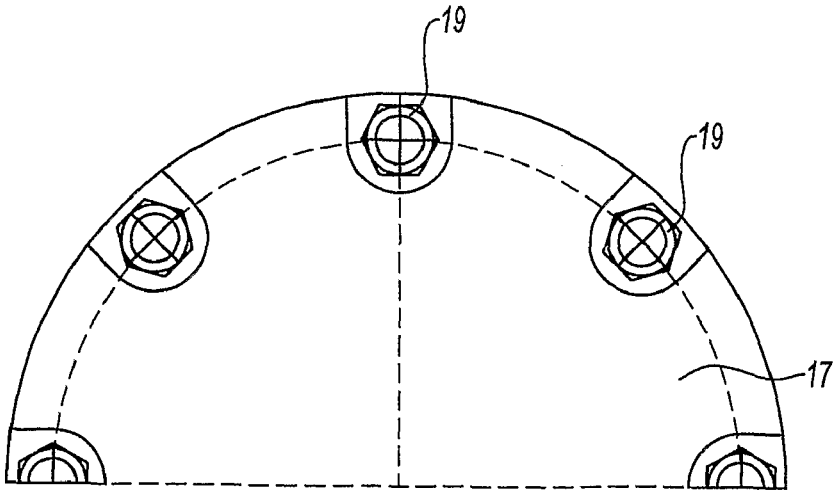

An exemplary embodiment of such a connector can be seen in FIGS. 2 and 3: this connector 11 comprises a short duct 13 surmounted by a welded collar 15 to which a blind flange 17 is fitted by appropriate fastening means such as screw and nut assemblies 19.

In this first variant, the two ducts 7*a* and 7*b* are ducts which exist independently of the question of recovering fluid situated inside the bunker 1 in the event of an emergency; it is however possible to envisage that the diameter of these two ducts is different from that of the ducts that are used routinely for ventilating the bunker 1.

Figure 4:
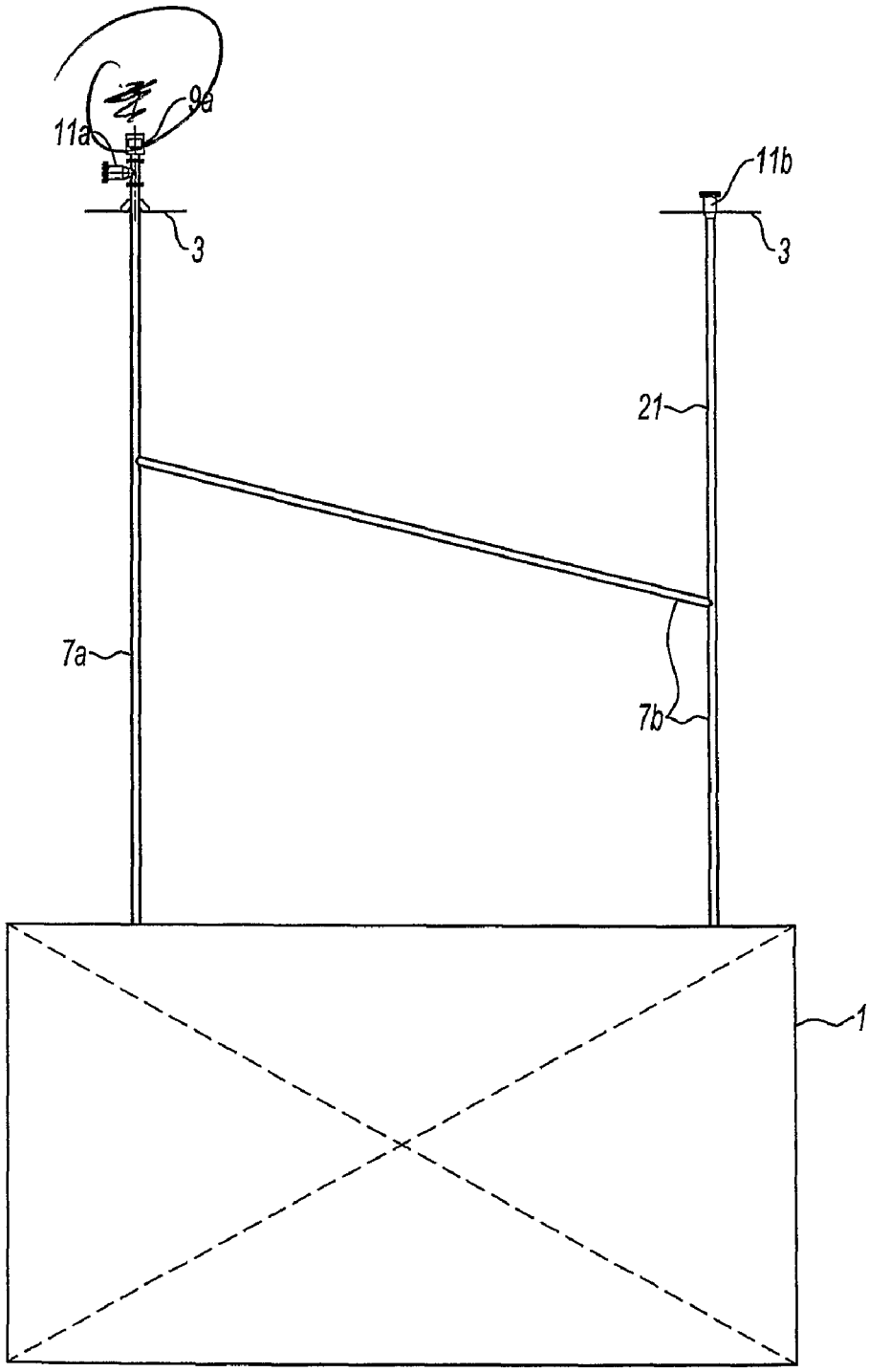

The variant of FIG. 4 differs from the foregoing in that the ventilation duct 7*b* is connected to the ventilation duct 7*a*, an additional salvage duct 21 then being interposed between the duct 7*b* and a connector 11*b* mounted on the deck 3 of the ship 5.

Figure 5:
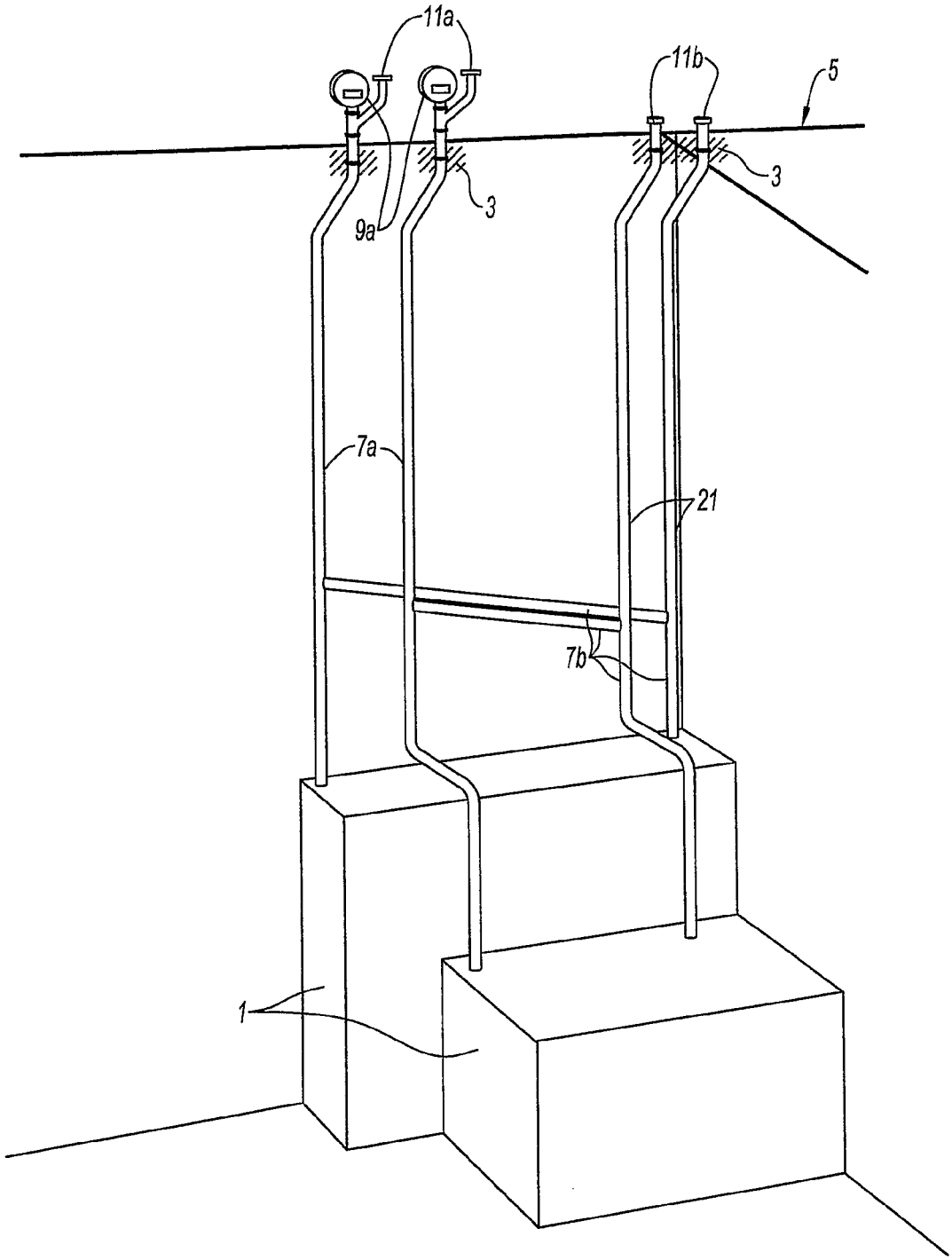
FIGS. 5 and 8 represent in perspective bunkers arranged according to FIGS. 4 and 7, FIGS. 9 and 10, 11 and 12, 13 and 14, 15 and 16, 17 and 18 represent, in respective views in elevation and from above for each case, various members communicating with a tanker tank, fitted with connectors allowing the recovery of the fluid situated inside this tank.

This second variant is particularly well-illustrated in FIG. 5, in which two bunkers 1 are shown each surmounted by its ventilation ducts 7*a*, 7*b*, the ducts 7*a* in turn being surmounted by their connectors 11*a* and their vents 9*a*, and the ducts 7*b* being surmounted, for their part, by their additional salvage ducts 21 and their connectors 11*b*.

Figure 6:
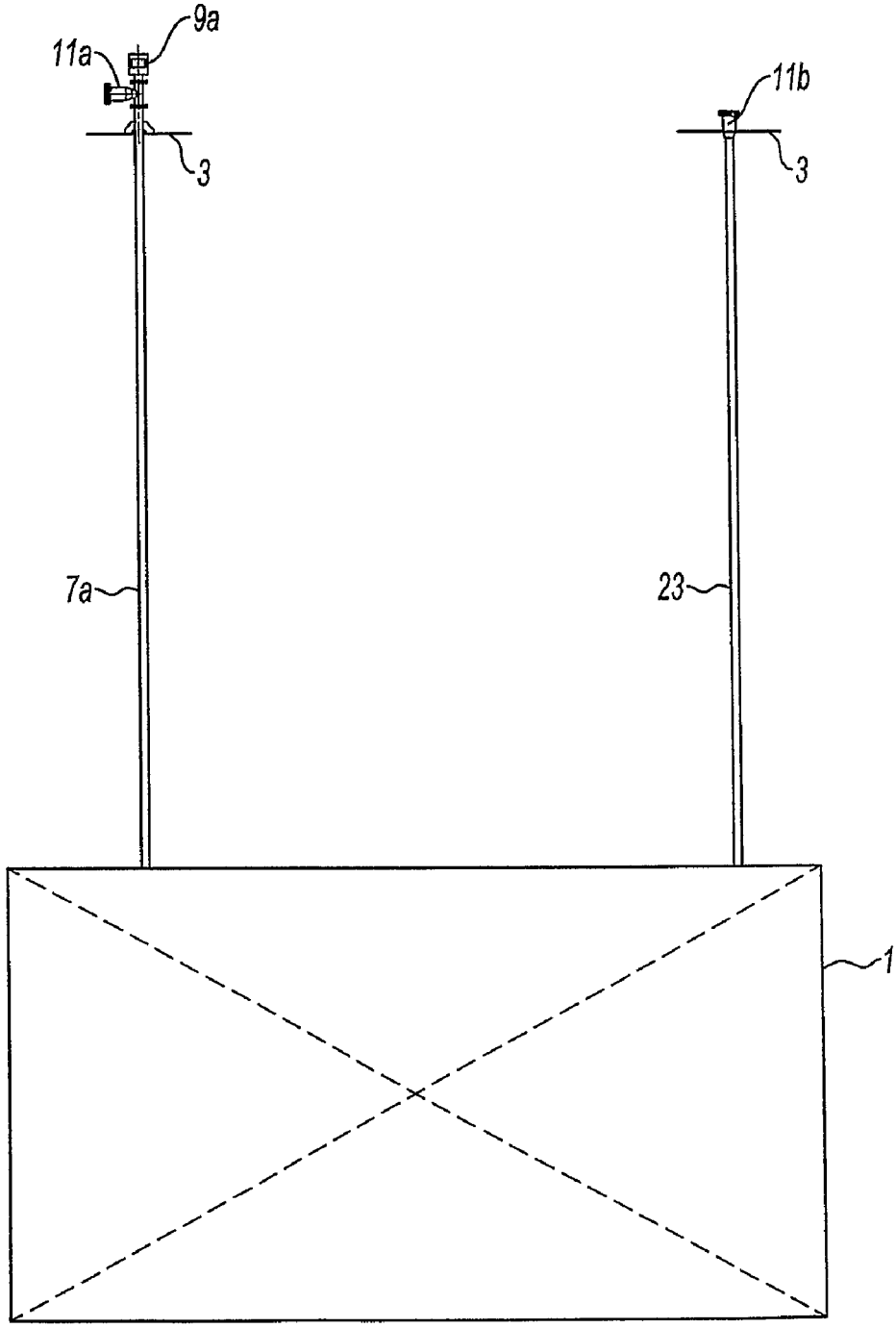

In the variant that can be seen in FIG. 6, the bunker 1 originally comprises only one ventilation pipe 7*a*, surmounted by a vent 9*a* and a connector 11*a*, and a specific salvage pipe 23 has been connected directly linking the bunker 1 to a connector 11*b* situated on the deck 3.

Figure 7:
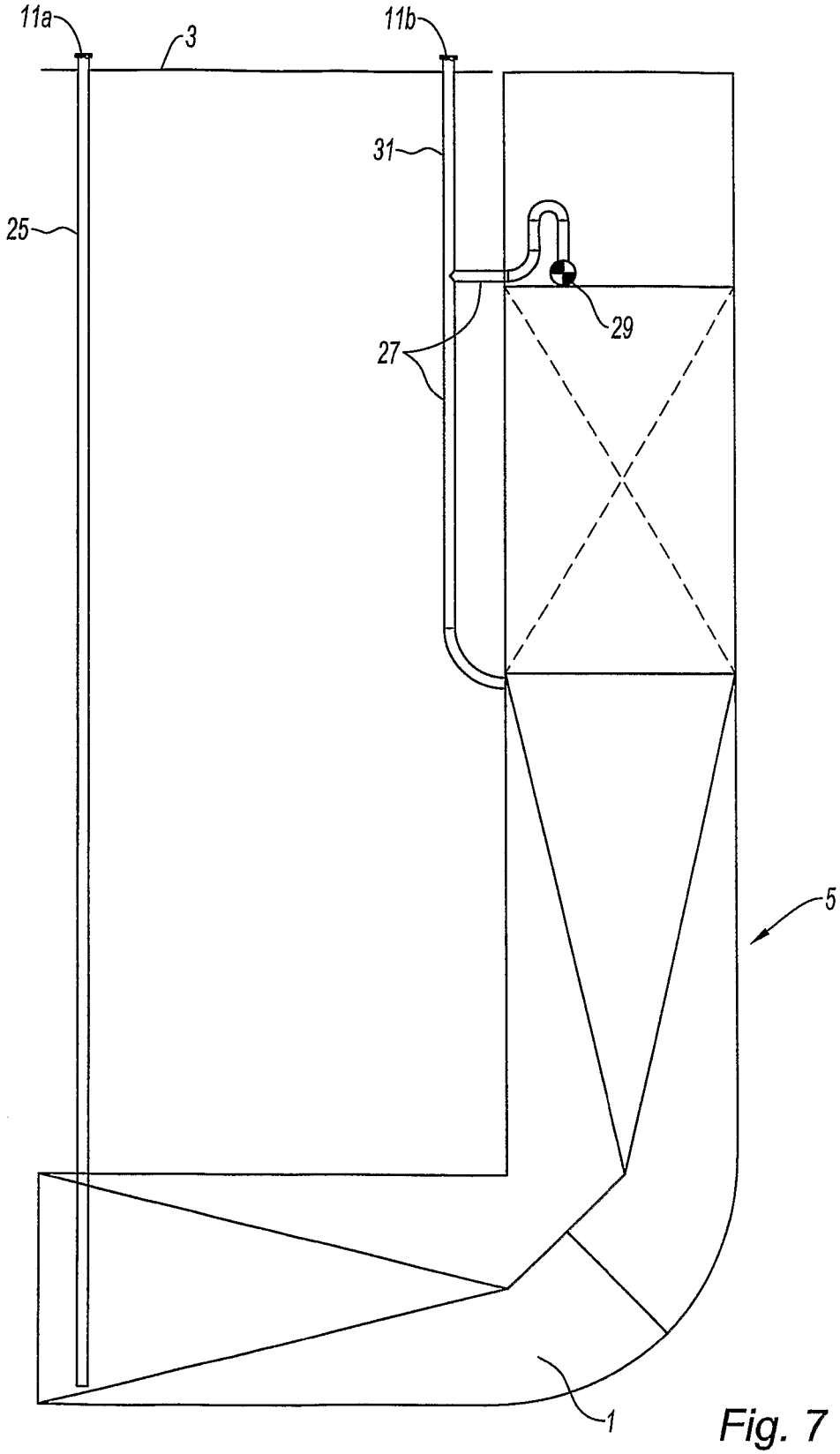

In the variant that can be seen in FIG. 7, the bunker 1 comprises a dipping duct 25 making it possible to measure the level of fluid situated inside the bunker 1, this duct being surmounted by a connector 11*a* situated on the deck 3 of the ship 5.

An overflow duct 27 is moreover provided, this duct making it possible to draw off into a circuit 29 the overflow of fluid situated inside the bunker 1.

To this overflow duct 27, existing on a standard ship, is fitted a salvage duct 31, surmounted by a connector 11*b* situated on the deck 3 of the ship 5.

Figure 8:
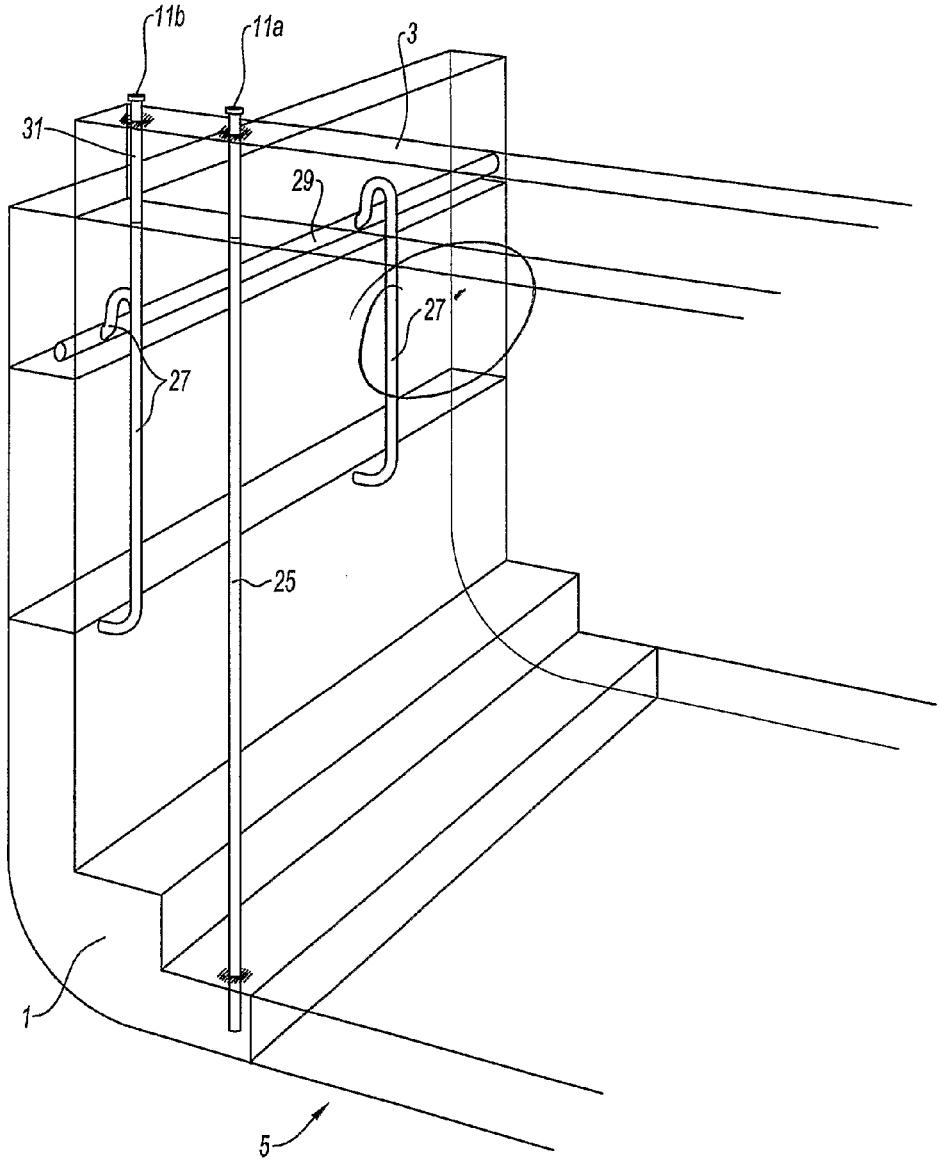

FIG. 8 shows particularly well the overflow duct 27 connected to the circuit 29; also seen in this figure is another overflow duct 27' which, for its part, is a standard duct, that is to say not surmounted by a salvage duct 31.

Reference is now made to FIGS. 9 to 19, concerning a ship in which the tank(s) of polluting fluid are tanks for transporting this fluid: the ship comprising these tanks may therefore be, for example, a tanker.

As is seen in these figures, the connectors designed for salvage operations are in this case incorporated into various members for communication with the tank.

Figure 9:
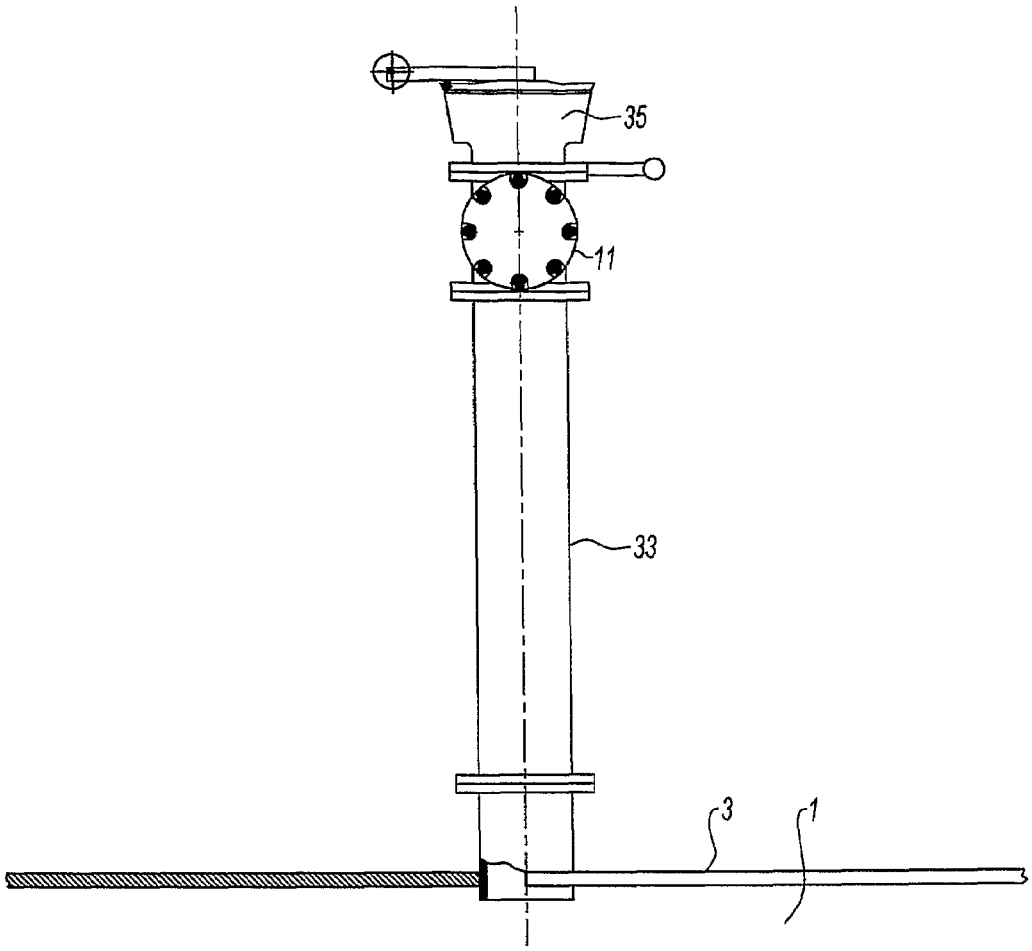
Figure 10:
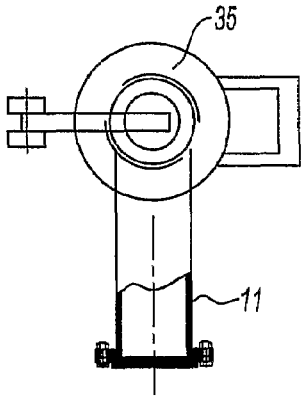

FIGS. 9 and 10 show a connector 11 of the type mentioned above fitted in a T-connection mounted on a ventilation duct 33 itself mounted on the deck 3 of the ship 5 and communicating with a rigid tank 1 situated beneath this deck.

As is known per se, such a ventilation duct may be surmounted by a ventilator 35.

Figure 11:
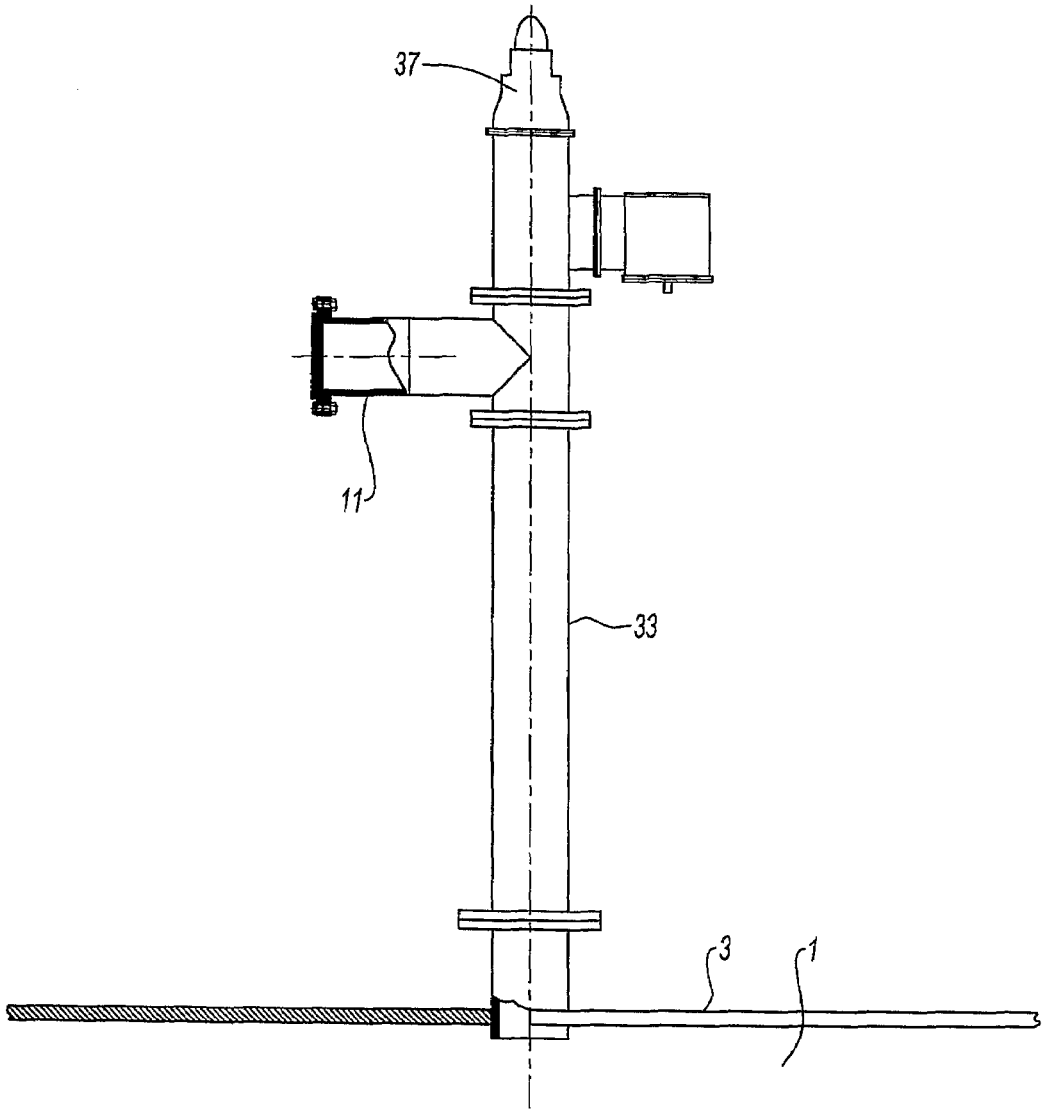
Figure 12:
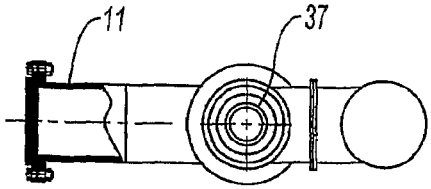

In FIGS. 11 and 12, the duct 33 furnished with the connector 11 is surmounted by a decompression valve 37, known per se, and making it possible to draw off to the outside of the tank 1 the pressurized gases contained in this tank.

Figure 13:
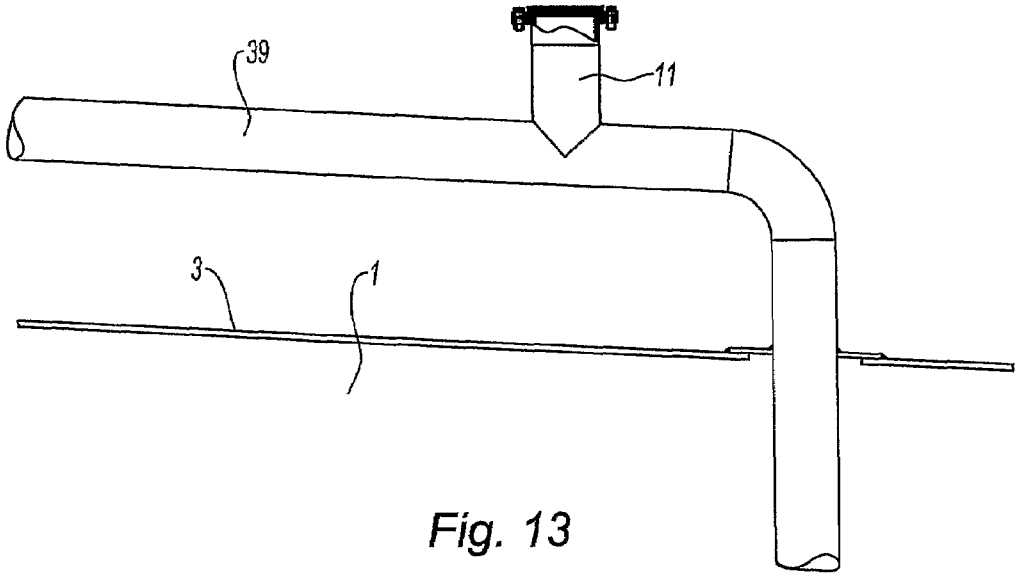
Figure 14:
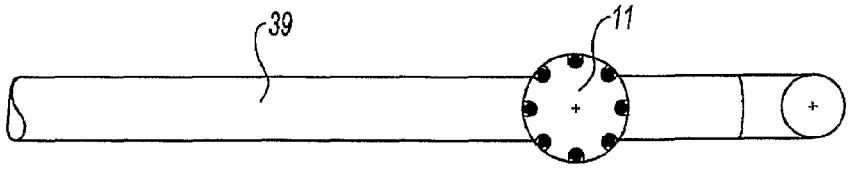

FIGS. 13 and 14 show a loading line 39, that is to say a duct allowing the tank 1 to be loaded with fluid to be transported.

In this case, the connector 11 may be fitted in a T-connection to the duct 39, so as to be directed upward, as can be seen in FIGS. 13 and 14.

Figure 15:
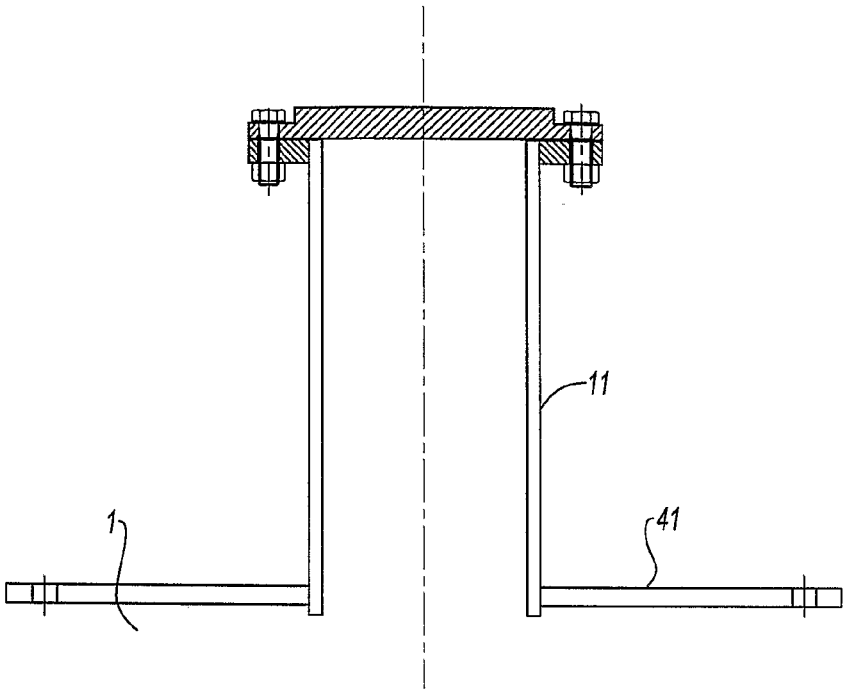
Figure 16:
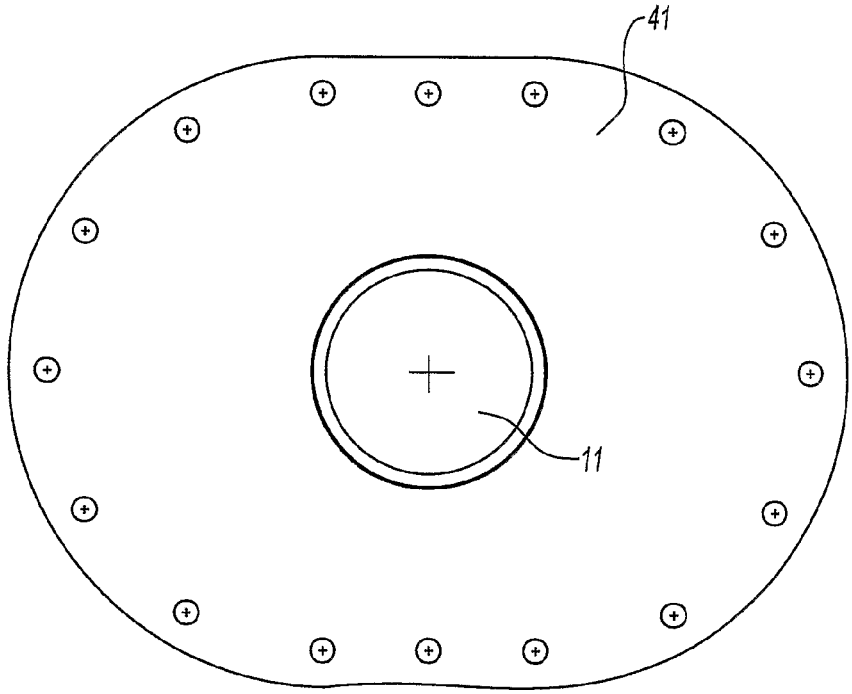

In the variant shown in FIGS. 15 and 16, the connector 11 is welded to a plate 41 itself bolted to the deck of the ship, above the tank 1; such a plate, of oblong shape for example as can be seen in FIG. 16, is routinely called a "manhole" plate and allows a person to go into the tank 1 in order to inspect it.

Figure 17:
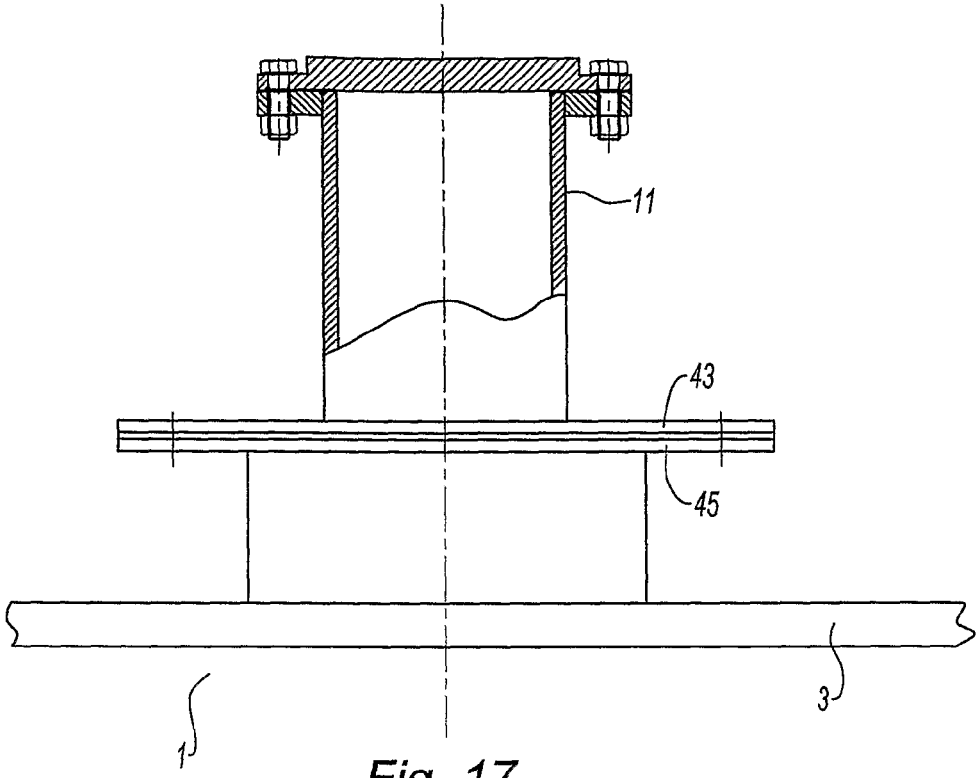
Figure 18:
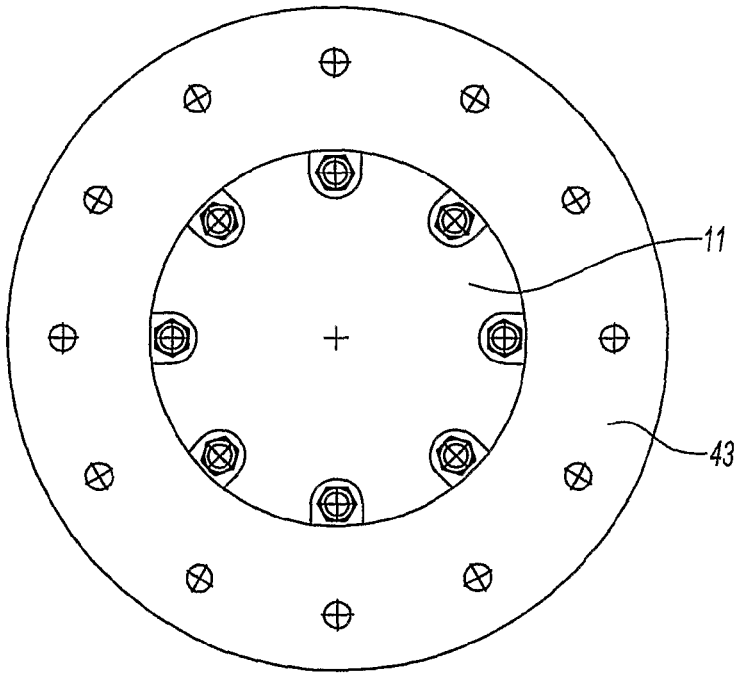

In the variant shown in FIGS. 17 and 18, the connector 11 is welded to a plate 43, itself bolted to a cleaning plug 45.

As is known per se, such a cleaning plug forms a passageway through the deck 3 of the ship making it possible to insert into the tank 1 tools for cleaning this tank.

Figure 19:
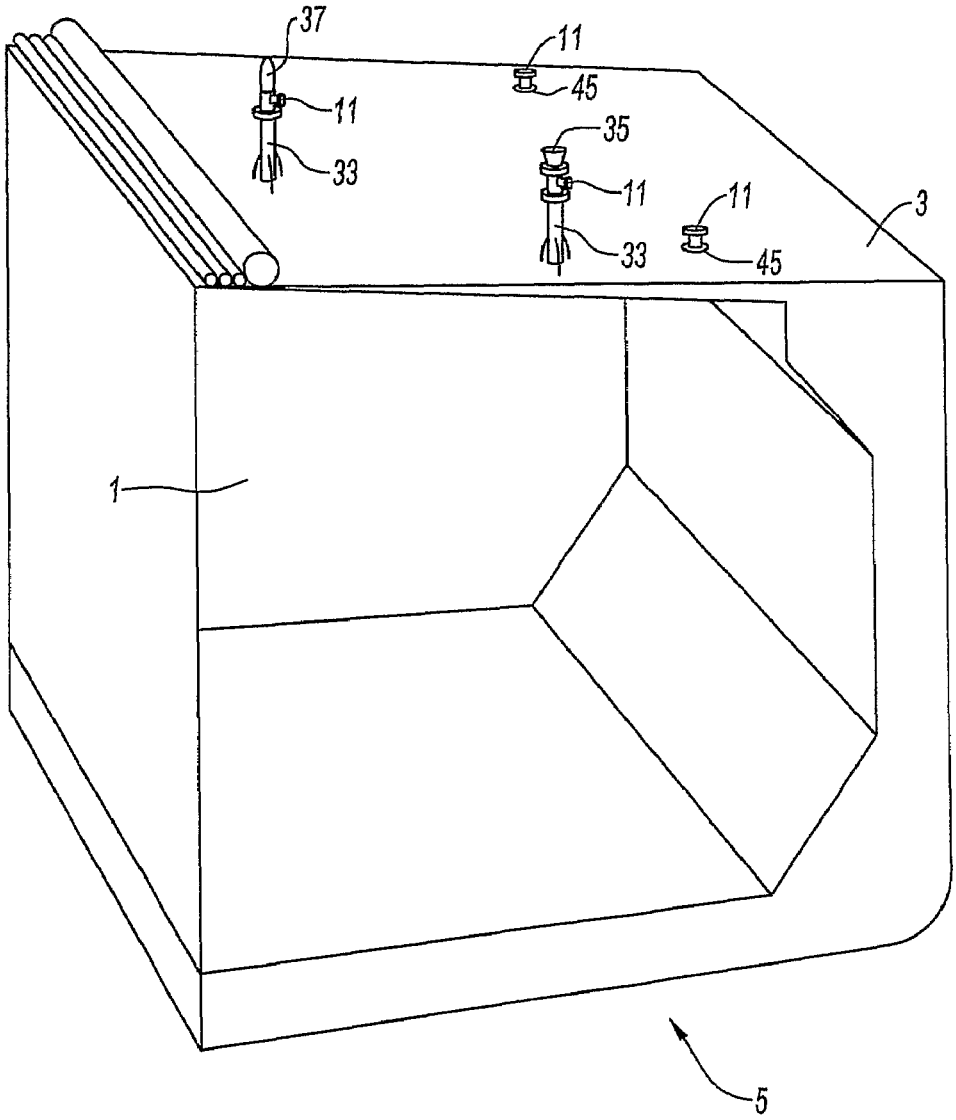
FIG. 19 represents a cross section of a tanker tank surmounted by a plurality of members represented in FIGS. 9 to 18.

FIG. 19 shows, as an example, a ventilation assembly 11, 33, 35, a decompression assembly 11, 33, 37 and two isolated connectors 11 mounted on cleaning plugs 45 attached to the deck 3 of a ship 5 above a tank 1.

Naturally any other combination of the members represented in FIGS. 9 to 18 is possible.

The operating mode and the advantages of the invention result directly from the foregoing description.

As it will have been possible to understand, the connectors 11 are connected to ducts which fulfill particular functions when the ship 3 is in a normal operating mode, that is to say outside salvage situations: these ducts make it possible, for example, to provide the ventilation, the decompression, the dipping, the filling, the emptying, the inspection or else the cleaning of the tank.

Installing the connectors 11 on these ducts therefore makes it possible to limit the number of piercings through the deck 3 of the ship 5, and therefore to reduce the complexity and the cost of installation of these salvage connectors.

It should be noted in addition that limiting the number of these piercings makes it possible to limit the number of weak points in the deck 3, and to increase free space on this deck.

In the event of an emergency for the ship 5, that is to say in particular in the event of stranding or sinking, salvors pierce the blind flanges 17 of the connectors 11 for example by means of a bell saw (or else they can unbolt this flange), and they attach to these connectors pipes making it possible on the one hand to inject seawater under pressure into the tank 1, and, on the other hand, to recover the polluting fluid situated inside the tank 1, expelled due to the inflow of the seawater.

Note that ensuring that the connectors 11 are situated on the deck 3 considerably eases access to them particularly by means of an ROV (remotely operated underwater vehicle).

Naturally, the present invention is in no way limited to the embodiments described and shown but are provided simply as examples.

It is in this way, for example, that it would be possible to envisage a single salvage connector per tank, mounted on a duct assigned at least partly to at least one function which is operational outside salvage situations: such a single connector would make it possible to introduce a pumping hose into the tank of a ship that has run aground or a ship of which at least one of the tanks has a breach.

It is in this way also that it would be possible to envisage more than two salvage connectors per tank.

The invention claimed is:

1. A floating craft, comprising:

at least one rigid tank of polluting fluid, said tank being a bunker for fuel necessary for propulsion of said floating craft, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, and wherein said connecting means comprise two independent ducts for ventilating said bunker, surmounted by said connectors and vents.

2. The floating craft as claimed in claim 1, comprising at least a first salvage connector and a second salvage connector communicating with said tank, wherein at least one of the first and second connectors is connected to said tank by said connecting means whereof at least a portion is assigned to at least one function that is operational outside salvage situations.

3. A floating craft, comprising:

at least one rigid tank of polluting fluid, said tank being a bunker for fuel necessary for propulsion of said floating craft, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, and wherein said connecting means comprise a first duct for ventilating said bunker surmounted by one of said connectors and a vent, a second ventilation duct connected to said first ventilation duct and a specific salvage duct connected to said second ventilation duct and surmounted by the other connector.

4. A floating craft, comprising:

at least one rigid tank of polluting fluid, said tank being a bunker for fuel necessary for propulsion of said floating craft, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, and wherein said connecting means comprise a duct for ventilating said bunker surmounted by one of said connectors and a vent, and a specific salvage duct connected to said bunker and surmounted by the other connector.

5. A floating craft, comprising:

at least one rigid tank of polluting fluid, said tank being a bunker for fuel necessary for propulsion of said floating craft, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, and wherein said connecting means comprise a duct for dipping said bunker surmounted by one of said connectors, an overflow duct connected to said tank, and a special salvage duct connected to said overflow duct and surmounted by the other connector.

6. A floating craft, comprising:

at least one rigid tank of polluting fluid and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, wherein said connecting means comprise a ventilation duct surmounted by one of said connectors and a ventilator.

7. A floating craft, comprising:

at least one rigid tank of polluting fluid, said tank being a tank for transporting said polluting fluid, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, wherein said connecting means comprise a decompression duct surmounted by one of said connectors and a decompression valve.

8. A floating craft, comprising:

at least one rigid tank of polluting fluid, said tank being a tank for transporting said polluting fluid, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, wherein said connecting means comprise a duct for filling said tank surmounted by one of said connectors.

9. A floating craft, comprising:

at least one rigid tank of polluting fluid, said tank being a tank for transporting said polluting fluid, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, wherein said connecting means comprise a manhole plate mounted removably on said tank and surmounted by one of said connectors.

10. A floating craft, comprising:

at least one rigid tank of polluting fluid, said tank being a tank for transporting said polluting fluid, and at least one salvage connector communicating with said tank, wherein the connector is connected to said tank by connecting means whereof at least a portion is assigned to at least one function which is operational outside salvage situations and the connector surmounts at least one duct adapted for connecting the tank directly to an exterior surface of the floating craft, wherein said function comprises at least one of ventilation of said tank, decompression of said tank, dipping of said tank, filling of said tank, draining of the overflow of said tank, inspection of said tank, and cleaning of said tank, wherein said connecting means comprise a cleaning plug mounted removably on said tank and surmounted by one of said connectors.

11. The floating craft as claimed in claim 3, wherein at least one of said connectors is connected in a T-connection to its associated duct.

12. The floating craft as claimed in claim 1, wherein said connectors are of the bolted blind flange type.

13. The floating craft as claimed in claim 1, wherein said connectors are placed above a deck of the floating craft.

* * * * *